US011794861B2

(12) United States Patent
Ding

(10) Patent No.: US 11,794,861 B2
(45) **Date of Patent: *Oct. 24, 2023**

(54) DOUBLE-CHAMBER INFLATABLE KAYAK

(71) Applicants: Advanced Elements, Inc., Benicia, CA (US); Paddle North LLC, Columbia Heights, MN (US); Weihai Winner Innovation Ocean Technology Co., LTD., Weihai (CN)

(72) Inventor: Xiaorong Ding, Weihai (CN)

(73) Assignees: Advanced Elements, Inc., Benicia, CA (US); Paddle North LLC, Columbia Heights, MN (US); Weihai Winner Innovation Ocean Technology Co., LTD., Weihai (CN)

( * ) Notice: Subject to any disclaimer, the term of this patent is extended or adjusted under 35 U.S.C. 154(b) by 31 days.

This patent is subject to a terminal disclaimer.

(21) Appl. No.: 17/478,775

(22) Filed: Sep. 17, 2021

(65) Prior Publication Data

US 2022/0001961 A1 Jan. 6, 2022

Related U.S. Application Data

(63) Continuation of application No. 16/771,627, filed as application No. PCT/CN2019/087063 on May 15, 2019, now Pat. No. 11,124,276.

(30) Foreign Application Priority Data

May 13, 2019 (CN) ..... 201920676834.2

(51) Int. Cl.
*B63B 34/22* (2020.01)
*B63B 7/08* (2020.01)

(52) U.S. Cl.
CPC ..... *B63B 34/22* (2020.02); *B63B 7/08* (2013.01)

(58) Field of Classification Search
CPC ..... B63B 34/22; B63B 7/08
See application file for complete search history.

(56) References Cited

U.S. PATENT DOCUMENTS 4,942,839 A * 7/1990 Chuan ..... B63B 43/06 441/40
5,299,524 A * 4/1994 Szilagyi ..... B63B 34/22 114/345

(Continued)

FOREIGN PATENT DOCUMENTS

CN 2148026 Y 12/1993
CN 201002702 Y 1/2008

(Continued)

OTHER PUBLICATIONS

Weihai Winner Innovation Ocean Technology Co., Ltd., International Search Report and Written Opinion for PCT/CN2019/087063, dated Feb. 6, 2020, 13 pgs.

(Continued)

*Primary Examiner* — S. Joseph Morano
*Assistant Examiner* — Jovon E Hayes
(74) *Attorney, Agent, or Firm* — Morgan, Lewis & Bockius LLP

(57) ABSTRACT

A double-chambers inflatable kayak, including an upper chamber and a lower chamber which are fixedly connected to each other by a connecting portion and between which a cavity is formed, wherein the upper chamber includes a cockpit hole and a first air valve provided on the surface, the cockpit hole being in communication with the cavity, and the first air valve being used to inflate and deflate the upper chamber, and wherein the lower chamber includes a second air valve which is used to inflate and deflate the lower chamber.

20 Claims, 2 Drawing Sheets

(56) References Cited

U.S. PATENT DOCUMENTS

| | | | | |
|---|---|---|---|---|
| 6,223,678 | B1 * | 5/2001 | Haller | B63B 34/22 114/345 |
| 6,539,889 | B2 * | 4/2003 | Simpson | B63B 7/082 114/345 |
| 6,863,014 | B2 * | 3/2005 | Hudson | B63B 34/22 114/345 |
| 6,880,481 | B2 * | 4/2005 | Dunn | B63H 16/02 114/345 |
| 7,021,233 | B2 * | 4/2006 | Hall | B63B 34/23 114/345 |
| 7,185,600 | B2 * | 3/2007 | Toussi | B63B 34/26 114/345 |
| 2008/0098945 | A1 * | 5/2008 | Weber | B63B 34/22 114/347 |
| 2009/0078186 | A1 * | 3/2009 | Rista | B63B 34/22 114/345 |
| 2011/0036284 | A1 * | 2/2011 | Chon | B63B 3/38 114/345 |
| 2021/0114697 | A1 * | 4/2021 | Ding | B63B 7/08 |

FOREIGN PATENT DOCUMENTS

| | | | |
|---|---|---|---|
| CN | 201082757 | Y | 7/2008 |
| CN | 101234664 | A | 8/2008 |
| CN | 202243949 | U | 5/2012 |
| CN | 202728516 | U | 2/2013 |
| DE | 2612881 | A1 | 9/1997 |

OTHER PUBLICATIONS

Ding, Notice of Allowance, U.S. Appl. No. 16/771,627, Aug. 9, 2021, 9 pgs.

* cited by examiner

DOUBLE-CHAMBER INFLATABLE KAYAK

RELATED APPLICATIONS

This application is a continuation of U.S. application Ser. No. 16/771,627, filed Jun. 10, 2020, entitled "Double-Chamber Inflatable Kayak," which is a national stage entry of PCT Application No. PCT/CN2019/087063, filed on May 15, 2019, which claims the priority of Chinese Patent Application No. 201920676834.2, filed May 13, 2019, which are hereby incorporated by reference in their entirety.

TECHNICAL FIELD

The present disclosure relates to water sports equipment and, in particular, to a double-chambers inflatable kayak.

BACKGROUND ART

With the improvement of living standards, inflatable kayaks have growing popularity among people who like entertainment on water. Inflatable kayaks have the advantages of light weight, small size, and flexibility on water, however, the safety & performance feature of inflatable kayaks currently on the market is low. What we used is full dropstitch material, can be inflated to MAX 18 psi, the recommendation is 10-12 psi. Most of current inflatable kayaks' material are made by single-layer PVC material, it can not be inflated more pressure inside, 1-5 psi, so it cannot be solid or strong enough. Moreover, if the inflatable kayaks encounter hard or sharp objects, their chambers will be easily penetrated and the kayaks will sink due to water leakage. Apparently, the safety factor & performance of inflatable kayaks currently on the market is low.

SUMMARY

The technical problem to be solved by the present disclosure is to make up for the above-mentioned shortcomings of the prior art, and to provide a double-chambers inflatable kayak with high safety & performance factor.

The above technical problem can be solved by the following technical solution.

A double-chambers inflatable kayak, including an upper chamber and a lower chamber which are fixedly connected through a connecting portion and between which a cavity is formed; wherein the upper chamber includes a cockpit hole and a first air valve provided on the surface, the cockpit hole being in communication with the cavity, and the first air valve being used for inflating and deflating the upper chamber; and wherein the lower chamber includes a second air valve for inflating and deflating the lower chamber.

Further, the connecting portion comprises a connecting layer and a sixth sealing strip, the connecting layer being arranged at related position between the upper chamber and the lower chamber and being fixedly connected with the upper chamber and the lower chamber
respectively; and sealing the sixth connection strip is fixedly connected with the upper chamber and the lower chamber respectively and fixedly surrounds the outer sides of the upper chamber and the lower chamber.

Further, the connecting layer is made of PVC sheet and has a width of 2 to 10 cm.

Further, the upper chamber comprises an upper chamber main body, a plurality of third sealing strips, a first sealing strip, and a first air chamber. The outside of the upper chamber main body being fixedly connected with the third sealing strips, the outside of the cockpit hole being fixedly connected with the first sealing strip, the upper chamber main body, the first sealing strip and the third sealing strips enclosing the first air chamber, and the first air valve being in communication with the first air chamber; and the lower chamber comprises a lower chamber main body, a fifth sealing strip and a second air chamber, the outside of the lower chamber main body being fixedly connected with the fifth sealing strip, the lower chamber main body and the fifth sealing strip enclosing the second air chamber, and the second air valve being in communication with the second air chamber.

Further, the upper chamber has a plurality of second sealing strips fixedly connected to the outer layer of upper chamber, make the outer is longer than inner of the upper chamber, then form a convex structure after inflation.

Further, the upper chamber has an inverted V-shaped structure including a first side and a second side which form an included angle of 160 to 175 degrees.

Further, the upper chamber has a "door-shaped" structure including a first side, a second side and a third side, both included angles between the first side and the third side and between the second side and the third side are 140 to 160 degrees.

Further, the lower chamber has a flat or concave structure after inflation, and when the lower chamber has a concave structure, the outer layer of the concave portion of the lower chamber is fixedly connected with a plurality of fourth sealing strips.

Further, the lower chamber has an upright V-shaped structure including a first bottom side and a second bottom side which form an included angle of 160 to 175 degrees.

Further, the lower chamber has an inverted "door-shaped" concave structure including a first bottom side, a second bottom side and a third bottom side, and both included angles between the first bottom side and the third bottom side and between the second bottom side and the third bottom side are 140 to 160 degrees.

Compared with the prior technology, the present disclosure has the following beneficial effects.

The present disclosure provides a double-chambers inflatable kayak comprising an upper chamber and a lower chamber. A cavity can be formed between the upper chamber and the lower chamber and a cockpit hole is arranged on the upper chamber such that a human body can be accommodated in the cavity through the cockpit hole, which is beneficial to the balance and stability of the human body on water. In addition, the present disclosure adopts a double-chambers design, i.e., an upper chamber and a lower chamber, which enables the kayak to still work normally in case of leakage of either chamber and thus improves the safety factor.

REFERENCE SIGNS

Figure 1:
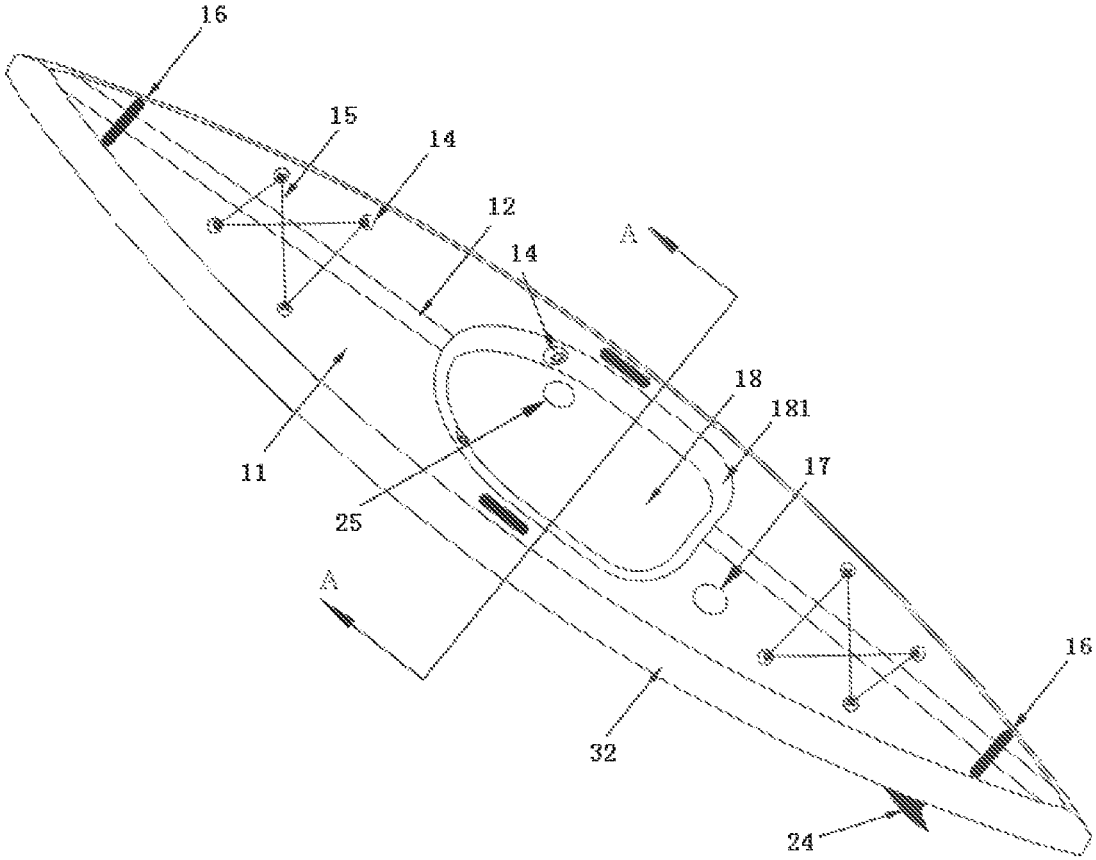
FIG. 1 is a schematic representation of the overall structure of the double-chambers inflatable kayak of the present disclosure.
Figure 2:
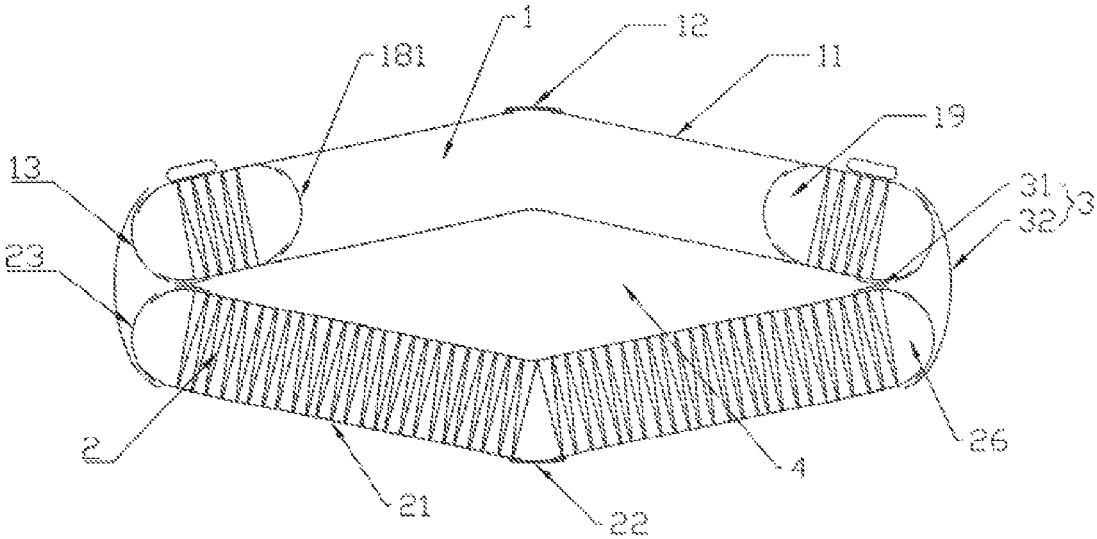
FIG. 2 is a sectional view of the section A-A shown in FIG. 1.
Figure 3:
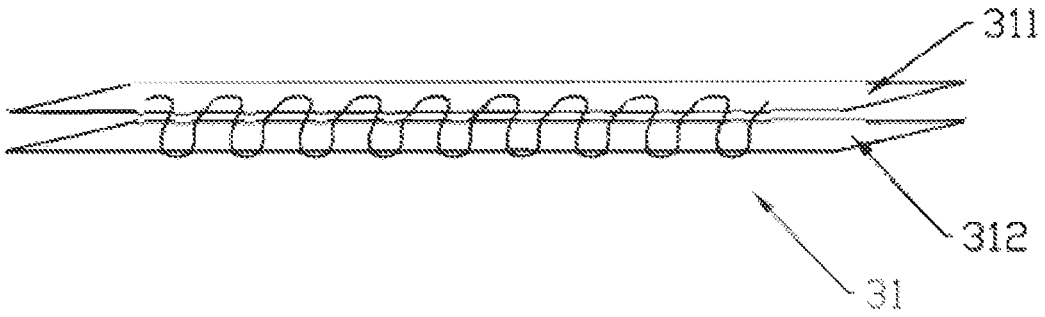
FIG. 3 is a schematic representation of the overall structure of the connecting layer of the present disclosure.

1 upper chamber; 101 first side; 102 second side; 103 third side; 11 upper chamber main body; 12 second sealing strip;

13 third sealing strip; 14 connecting ring; 15 elastic string; 16 handle; 17 first air valve; 18 cockpit hole; 181 first sealing strip; 19 first air chamber; 2 lower chamber; 201 first bottom side; 202 second bottom side; 203 third bottom side; 21 lower chamber main body; 22 fourth sealing strip; 23 fifth sealing strip; 24 tail vane; 25 second air valve; 26 second air chamber; 3 connecting portion; 31 connecting layer; 311 upper layer; 312 lower layer; 32 sixth sealing strip; 4 cavity.

DETAILED DESCRIPTION

Additional features and aspects of the present disclosure will become apparent from the following description of exemplary examples with reference to the attached drawings.

In order to facilitate understanding, the components of the inflatable kayak are enlarged (thickened) or shrunk (thinned) in the drawings, but this is not intended to restrict the scope of protection of the present disclosure.

Any term in the singular applies to the plural and vice-versa.

In the description of the examples of the present disclosure, it should be noted that the orientation or positional relationship indicated by the terms "upper", "lower", "inner", "outer" and the like, if any, is the orientation or positional relationship as shown in the drawings, or is the orientation or positional relationship in which the product of the present disclosure is normally placed when in use, and is only intended for convenient and simplified description of the present disclosure, rather than indicating or implying that a device or an element must be positioned in a specific orientation or must be constructed and operated in a specific orientation, and therefore cannot be interpreted as a limitation to the present disclosure. In addition, in the description of the present disclosure, in order to differentiate different units, words such as first and second are used herein, but the use of the sequence words is not restricted by the order of manufacture of the units, nor can it be understood as indicating or implying relative importance. In the detailed description and claims of the disclosure, the names of the units may be different.

The terms used herein are intended for explaining the examples of the present disclosure, rather than limiting the present disclosure. It should also be noted that, unless otherwise expressly specified in the specification, the terms "provide", "continue", and "connect", if any, should be interpreted in a broad sense; for example, there can be fixed connection, detachable connection, or integrated connection; or there can be mechanical connection, direct connection, or indirect connection through a medium; or there can be internal communication of two elements. Those skilled in the art can understand the specific meanings of the above-mentioned terms in the present disclosure.

The present disclosure provides a double-chambers inflatable kayak which comprises an upper chamber 1, a lower chamber 2, and a connecting portion 3. The upper chamber 1 and the lower chamber 2 are connected together through the connecting portion 3, and a cavity 4 is formed between the upper chamber 1 and the lower chamber 2. The upper chamber 1 comprise a cockpit hole 18 provided in the middle. The cockpit hole 18 and the cavity 4 communicate with each other. A human body can be accommodated in the cavity 4 through the cockpit hole 18 to ensure the safety of the human body.

Figure 4:
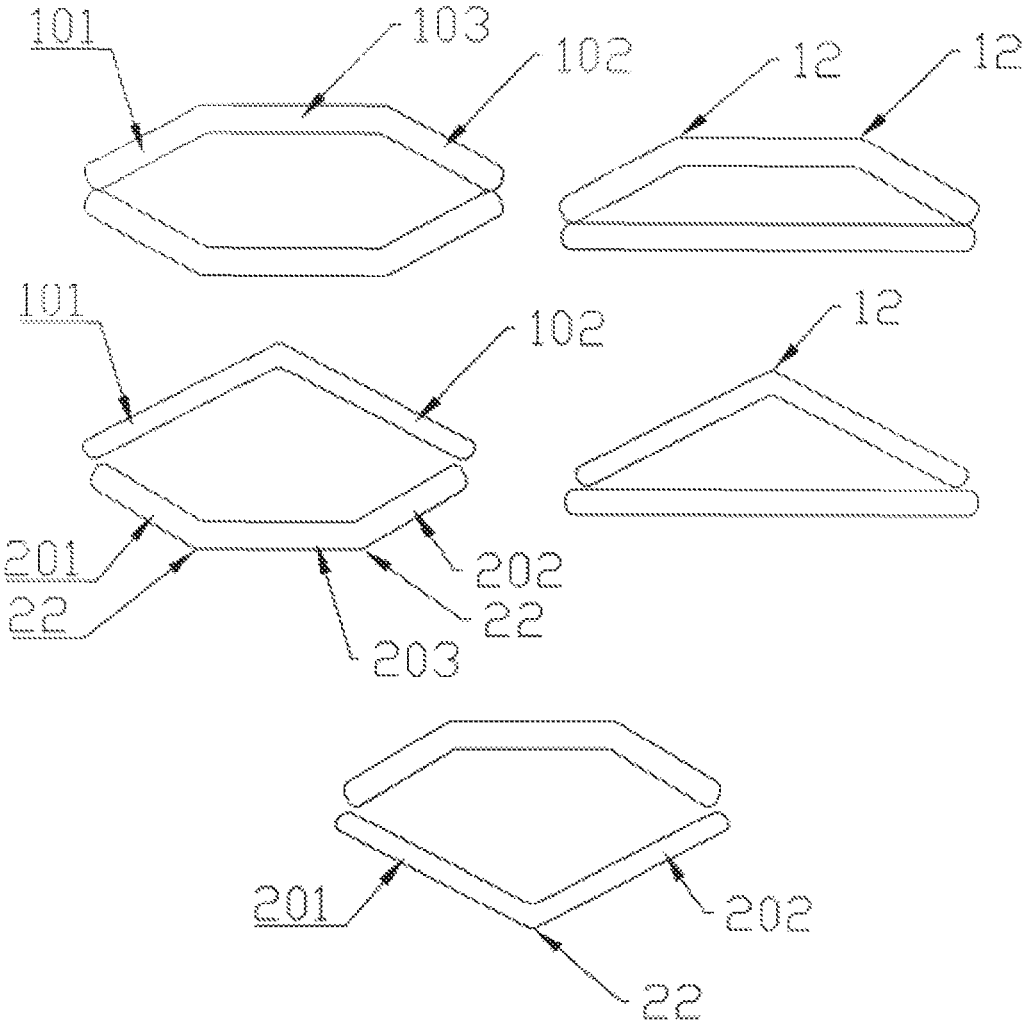
FIG. 4 is a schematic representation of the shapes of some structures of the upper and lower chambers of the present disclosure.

The outside of the cockpit hole 18 of the upper chamber 1 is sealed by a first sealing strip 181. After inflation, the upper chamber 1 has an overall convex structure, and a plurality of second sealing strips 12 are connected to the outer layer of the convex portion to enhance the rigidity of the convex portion to prevent damage. In order to prevent water from flowing backward, the upper chamber 1 cannot be configured to be a flat or concave structure. The overall shape of the upper chamber 1 is as shown in FIG. 4. The upper chamber 1 can be an inverted V-shaped structure or a "door-shaped" concave structure. In the case of an inverted V-shaped structure, the upper chamber 101 comprises a first side 101 and a second side 102, and preferably an included angle between the first side 101 and the second side 102 is 160 to 175 degrees. In the case of a "door-shaped" structure, the upper chamber 101 comprises a first side 101, a second side 102 and a third side 103, and preferably both included angles between the first side 101 and the third side 103 and between the second side 102 and the third side 103 are 140 to 160 degrees.

The upper chamber 1 further comprises an upper chamber main body 11, a plurality of third sealing strips 13, a first air valve 17, and a first air chamber 19. The peripheral sides of the upper chamber main body 11 are sealed by the third sealing strips 13. The upper chamber main body 11, the first sealing strip 181 and the third sealing strip 13 jointly enclose the first air chamber 19 to ensure the independence of the first air chamber 19 of the upper chamber 1. The first air valve 17 penetrates into the first air chamber 19. When in use, air is injected into the upper chamber main body 11 through the first air valve 17 to fill the entire upper chamber main body 11. A single air chamber is convenient for rapid inflation when in use. When not in use, air in the first air chamber 19 can be discharged through the first air valve 17.

After inflation, the lower chamber 2 has an overall flat or concave structure, and a plurality of fourth sealing strips 22 are connected to the outer layer of the concave portion to enhance the rigidity of the concave portion and prevent damage. The overall shape of the lower chamber 2 is as shown in FIG. 4. The lower chamber 2 may have a flat bottom or an upright V-shaped structure or an inverted "door-shaped" structure. In the case of an upright V-shaped structure, the lower chamber 2 comprises a first bottom side 201 and a second bottom side 202, and preferably an included angle between the first bottom side 201 and the second bottom side 202 is 160 to 175 degrees. In the case of an inverted "door-shaped" structure, the lower chamber 2 comprises a first bottom side 201, a second bottom side 202, and a third bottom side 203, and preferably both included angles between the first bottom side 201 and the third bottom side 203 and between the second bottom side 202 and the third bottom side 203 are 140 to 160 degrees.

The lower chamber 2 further includes a lower chamber main body 21, a fifth sealing strip 23, a second air valve 25, and a second air chamber 26. The peripheral sides of the lower chamber main body 21 are sealed by the fifth sealing strip 23, and the lower chamber main body 21 and the fifth sealing strip 23 enclose the second air chamber 26 to ensure the independence of the second air chamber 26 of the lower chamber 2. The second air valve 25 penetrates into the second air chamber 26. When in use, the air is injected into the lower chamber main body 21 through the second air valve 25 to fill the entire lower chamber main body 21. A single air chamber is convenient for rapid inflation when in use. When not in use, the air in the second air chamber 26 can be discharged through the second air valve 25.

The connecting portion 3 comprises a connecting layer 31 and a sixth sealing strip 32.

Preferably, the connecting layer 31 consists of two layers, which are fixedly connected to the upper and lower chambers at an edge position between the upper chamber and the lower chamber, respectively, and which are fixedly connected to each other at a middle position in the length direction of the upper and lower chambers. The width of the connecting layer 31 is 2 to 10 cm. It should be noted that the length of the connecting layer 31 is not limited in the present disclosure, as long as the upper chamber 1 and the lower chamber 2 can be firmly connected together. The connecting layer 31 consists of an upper layer 311 and a lower layer 312. Preferably, the upper and lower layers are made of PVC sheet, and are stitched together with a high-strength thread, such as nylon thread, and are adhered together with polyurethane glue.

The connecting layer 31 is arranged between the upper chamber 1 and the lower chamber 2.

The upper layer 311 of the connecting layer 31 and the upper chamber 1 are bonded to each other, and the lower layer 312 of the connecting layer 31 and the lower chamber 2 are bonded to each other, such that the peripheral edge of the upper chamber 1 and the peripheral edge of the lower chamber 2 are tightly connected, forming a cavity 4 in the middle. The peripheral sides of the upper chamber 1 and the lower chamber 2 are connected and sealed by sealing the sixth connection strip 32 to form secondary protection to prevent the sides from being worn or punctured.

The upper chamber 1 is provided with a plurality of connecting rings 14 and an elastic sting 15. The connecting rings 14 may be provided at one end or both ends of the upper chamber 1. The elastic string 15 passes through the connecting rings 14 to form a net structure. When the inflatable kayak is in use, the passenger's articles can be fixed on the upper chamber 1 through the elastic string 15. The material of the connecting rings 14 may be metal or plastic or PVC sheet. It should be noted that the specific positions and the number of the connecting rings 14 are not limited in the present disclosure, and as long as the elastic string 15 can be effectively fixed, the positions and the number of the connecting rings all fall within the scope of protection of the claims of the present disclosure.

The upper chamber 1 is provided with a plurality of handles 16 for carrying the inflatable kayak of the present disclosure. It should be noted that the specific positions and the number of the handles 16 are not limited in the present disclosure, and as long as there is(are) a handle 16 (handles 16) fixed to the upper chamber 1, such structure falls within the scope of protection of the claims of the present disclosure.

A tail vane 24 is provided at the tail of the lower chamber 2 to control the navigation direction of the inflatable kayak.

The material of the upper chamber main body 11 and the lower chamber main body 21 is a wiredrawing material, and preferably a wiredrawing pad in this example. The upper and lower sides of the wiredrawing pad are both made of a soft plastic, with dense and free filaments of a fixed length in the middle. The filaments connect the soft plastic upper and lower sides, and are sealed from the outside. After inflation, the filaments will ensure the flatness of the two soft plastic surfaces and the overall air pressure resistance.

The material of the first sealing strip 181, the second sealing strip 12, the third sealing strip 13, the fourth sealing strip 22, the fifth sealing strip 23, and sealing the sixth connection strip 32 is preferably PVC sheet. PVC sheet is a kind of cloth product which is formed by wrapping textile fiber mesh with soft plastic by hot pressing. PVC sheet can seal all sides of the wiredrawing pad by means of hot pressing or glue.

The third sealing strip 13 and the fifth sealing strip 23 can be connected to the outside of the upper chamber main body 11 and the outside of the lower chamber main body 21 by hot pressing or glue, respectively, thereby sealing the upper chamber main body 11 and the lower chamber main body 21, so as to enhance the rigidity of the sides of the upper chamber main body 11 and the lower chamber main body 21 to prevent the sides from being worn or punctured.

In the present disclosure, if the upper chamber 1 and the lower chamber 2 are directly fixedly connected, such as sewing the upper chamber 1 and the lower chamber 2 together, the upper and lower chambers will be incomplete and easily leak after being inflated. If the upper chamber 1 and the lower chamber 2 are directly bonded together, the pressure inside the upper chamber 1 and the lower chamber 2 will increase after inflation, which will result in insufficient strength and easy cracking at the bonded part. In order to solve the connection problem of the upper and lower chambers, the present disclosure is provided with a connecting layer 31. The upper and lower chambers are fixedly connected through the connecting layer 31, which not only ensures the integrity of the upper and lower chambers but also ensures the stable connection of the upper and lower chambers. In addition, the connecting layer 31 also can position the upper and lower chambers to ensure that they stay in fixed positions during inflation.

The specific examples of the present disclosure have been described in detail above. For those skilled in the art, modifications and improvements can be made to the present disclosure without departing from the principles of the present disclosure. The modifications and improvements are also covered by the protection scope of the claims of the present disclosure.

The invention claimed is:

1. A kayak, comprising:

an upper chamber that includes a cockpit hole, and a first air valve;

a lower chamber that includes a second air valve;

a connecting portion connecting the upper chamber and the lower chamber; and a cavity between the upper chamber and the lower chamber, wherein the cockpit hole is in communication with the cavity.

2. The kayak of claim 1, wherein the first air valve is configured to be used for inflating and deflating the upper chamber, and the second air valve is configured to be used for inflating and deflating the lower chamber.

3. The kayak of claim 1, wherein the connecting portion comprises a connecting layer and a first sealing strip, the connecting layer being arranged at an inner edge between the upper chamber and the lower chamber to fixedly connect the upper chamber and the lower chamber, wherein the connection strip is fixedly connected to an outer portion of the upper chamber and the lower chamber, and fixedly surrounds an outside of the upper chamber and the lower chamber.

4. The kayak of claim 3, wherein the connecting layer comprises a PVC sheet, the connecting layer having a width between approximately 2 to approximately 10 cm.

5. The kayak of claim 3, wherein the connecting layer comprises an upper layer and a lower layer coupled via a stitched thread and glue.

6. The kayak of claim 5, wherein the thread comprises nylon thread, and the glue comprises polyurethane glue.

7. The kayak of claim 1, wherein the upper chamber comprises:

an upper chamber main body;

a second sealing strip;

a plurality of third sealing strips; and a first air chamber.

8. The kayak of claim 7, wherein an outer portion of the upper chamber main body is fixedly connected with the third sealing strips, an outer portion of the cockpit hole is fixedly connected with the second sealing strip; and wherein the upper chamber main body, the second sealing strip and the plurality of third sealing strips encloses the first air chamber; and the first air valve is in communication with the first air chamber; and the lower chamber comprises a lower chamber main body, a fourth sealing strip and a second air chamber; outside of the lower chamber main body is fixedly connected with the fourth sealing strip; the lower chamber main body and the fourth sealing strip enclose the second air chamber; and the second air valve is in communication with the second air chamber.

9. The kayak of claim 8, wherein the upper chamber main body and the lower chamber main body comprise wiredrawing pads, and wherein:

upper and lower sides of the wiredrawing pads comprise soft plastic;

dense and free filaments of a fixed length are disposed in a middle portion of the wiredrawing pads, and wherein the filaments connect the upper and lower sides, and are sealed from the outside.

10. The kayak of claim 9, wherein after inflation, the filaments provide an overall air pressure resistance.

11. The kayak of claim 1, wherein the upper chamber has a convex structure after inflation, and a plurality of fifth sealing strips are fixedly connected to an outmost layer of the convex portion of the upper chamber.

12. The kayak of claim 1, wherein the upper chamber has an inverted V-shaped structure including a first side and a second side, an angle between the first side and the second side is between approximately 160 to approximately 175 degrees.

13. The kayak of claim 1, wherein the upper chamber comprises a first side, a second side, and a third side, and a first angle between the first side and the third side, and a second angle between the second side and the third side are between approximately 140 to approximately 160 degrees.

14. The kayak of claim 1, wherein the lower chamber has a flat or concave structure after inflation.

15. The kayak of claim 9, wherein the lower chamber has a concave shape, an outmost layer of a concave portion of the lower chamber is fixedly connected with a plurality of sixth sealing strips.

16. The kayak of claim 1, wherein the lower chamber comprises an upright V-shaped structure including a first bottom side and a second bottom side, an angle between the first bottom side and the second bottom side is between approximately 160 to approximately 175 degrees.

17. The kayak of claim 1, wherein the lower chamber comprises an inverted concave structure including a first bottom side, a second bottom side and a third bottom side, and wherein a first angle between the first bottom side and the third bottom side, and a second angle between the second bottom side and the third bottom side are between approximately 140 to approximately 160 degrees.

18. The kayak of claim 1, wherein the kayak is a double-chamber inflatable kayak.

19. The kayak of claim 1, further comprising:

a plurality of connecting rings provided at an end of the upper chamber; and an elastic string configured to pass through the plurality of connecting rings to form a net structure.

20. The kayak of claim 1, further comprising a tail vane provided at a tail of the lower chamber, wherein the tail vane is configured to control a navigation direction of the kayak.

* * * * *